US007683743B2

(12) United States Patent
Chuang

(10) Patent No.: US 7,683,743 B2
(45) Date of Patent: Mar. 23, 2010

(54) FILTERING CIRCUIT AND STRUCTURE THEREOF

(75) Inventor: Chia-Cheng Chuang, Kaohsiung (TW)

(73) Assignee: Industrial Technology Research Institute, Hsinchu (TW)

( * ) Notice: Subject to any disclaimer, the term of this patent is extended or adjusted under 35 U.S.C. 154(b) by 0 days.

(21) Appl. No.: 11/964,714

(22) Filed: Dec. 27, 2007

(65) Prior Publication Data

US 2009/0045890 A1 Feb. 19, 2009

(30) Foreign Application Priority Data

Aug. 13, 2007 (TW) ..... 96129844 A

(51) Int. Cl.
*H01P 1/203* (2006.01)
*H01P 1/20* (2006.01)

(52) U.S. Cl. ..... 333/204; 333/117; 333/202

(58) Field of Classification Search ..... 333/202, 333/204, 206, 203, 117, 118, 120, 121
See application file for complete search history.

(56) References Cited

U.S. PATENT DOCUMENTS 4,281,302 A 7/1981 Stegens
4,551,696 A 11/1985 Moutrie et al.
4,578,656 A 3/1986 Lacour et al.
5,105,173 A 4/1992 Itou
5,831,497 A * 11/1998 Yorita et al. ..... 333/202

FOREIGN PATENT DOCUMENTS

WO 2006095984 A1 9/2006

OTHER PUBLICATIONS

1~ G.L. Matthaei, L. Young, and E. M. T. Jones, Microwave Filters, Impedance Matching Networks and Coupling Structures, pp. 626-632, New-York: McGraw-Hill, 1980.
2~ Rajesh Mongia, Inder Bahl, and Prakash Bhartia, RF and Microwave Coupled-Line Circuits, pp. 98-101 Artech House, 1999.
Article titled "Microstrip tapped-line filter design" authored by Joseph S. Wong, IEEE Trans. Microwave Theory and Techniques, vol. MTT-27, No. 1, Jan. 1979 (pp. 44-50).

* cited by examiner

*Primary Examiner*—Stephen E Jones
(74) *Attorney, Agent, or Firm*—Jianq Chyun IP Office

(57) ABSTRACT

A filtering circuit and a structure thereof are provided. The filtering circuit includes an input terminal, an output terminal, a resonant circuit, a first coupling portion, and a second coupling portion. The resonant circuit is coupled between the input terminal and the output terminal and includes M resonators which are arranged in sequence. A signal received by the input terminal can be transmitted to the output terminal by the resonant circuit through inter-coupling between adjacent resonators. The first coupling portion and the second coupling portion are respectively coupled to non-adjacent resonators. A part of the signal received by the input terminal is transmitted to the second coupling portion via the first coupling portion through cross-couple. Thereby, sideband interference can be further suppressed.

18 Claims, 8 Drawing Sheets

FILTERING CIRCUIT AND STRUCTURE THEREOF

CROSS-REFERENCE TO RELATED APPLICATION

This application claims the priority benefit of Taiwan application serial no. 96129844, filed on Aug. 13, 2007. The entirety of the above-mentioned patent application is hereby incorporated by reference herein and made a part of this specification.

BACKGROUND OF THE INVENTION

1. Field of the Invention

The present invention generally relates to a high-frequency filtering technique in filtering circuit and a structure thereof.

2. Description of Related Art

In a communication system, signals in all other bands except the operation band are considered interferences, and these interferences may affect the communication quality of the system. Accordingly, a filter is usually disposed in a communication system for passing signals in the operation band and filtering out those signals in other bands. After a signal in the operation band is passed through a filter, the power loss of the signal has to be kept at a low level. In other words, a signal in the operation band passed through the filter has to be close to the original signal. The signals out of the operation band have to be effectively suppressed by the filter in order to ensure a good communication quality of the system.

In a planar circuit, microstrips or striplines are usually used for implementing a filter. FIG. 1 is a circuit diagram of a conventional quarter wavelength inter-digital coupled-line filter implemented with microstrips. Referring to FIG. 1, the filter 100 receives a signal through an input terminal $T_{in}$ and then sequentially transmits the signal to an output terminal $T_{out}$ through N coupled lines 130_1~130_N. The coupled lines 130_1~130_N are all microstrips of quarter wavelength, wherein one terminals of the coupled lines 130_1~130_N are grounded, and the other terminals thereof are open. Since the coupled lines 130_1~130_N are equivalent to resonators composed of capacitors and inductors, the filter is filtered by a plurality of capacitors and inductors when the signal is sequentially transmitted to the output terminal $T_{out}$ through the coupled lines 130_1~130_N. FIG. 2 is a circuit diagram of another conventional quarter wavelength inter-digital coupled-line filter implemented with microstrips. Referring to FIG. 2, the circuit structure of the filter 200 is similar to that of the filter 100 illustrated in FIG. 1. The difference is that in the filter 200, the input terminal $T_{in}$ is connected to an input transmission line 210, and the input transmission line 210 is directly plugged into the first microstrip 230_1. Besides, the output transmission line 220 is directly plugged into the last microstrip 230_N.

In foregoing two filters 100 and 200, three methods are adopted for increasing the coupling from input terminal to output terminal through the coupled lines, including reducing the line widths of the coupled lines, increasing the thickness of the substrate; and reducing the gap width between the coupled lines. However, reduction in the line widths of the coupled lines may reduce the quality factor of the resonators and accordingly increase the transmission loss of the resonators. The effect brought by increasing the thickness of the substrate is very limited, and under the trend of slimming circuit boards, thick substrates have become outdated. The method of reducing the gap width between the coupled lines is the most effective one; however, the smaller the gap width between the coupled lines is, the greater negative affections resulted from the variation of a circuit board fabrication process for the small gap width. FIG. 3 illustrates the affection of the gap width between parallel coupled microstrips to signal coupling with fixed substrate thickness, substrate dielectric coefficient, and line width. As shown in FIG. 3, the smaller the gap width is, the more the signal coupling changes. Accordingly, a slight process variation can deviate the response of a filter away from the original design and accordingly reduce the yield of filters in mass production.

A band-pass filter with quarter wavelength transmission lines as illustrated in FIG. 4 has been disclosed in European patent. NO. WO 2006/095984 A1. Referring to FIG. 4, the band-pass filter 400 includes an input terminal 410, an output terminal 420, resonators 431~433, and transmission lines 441~442. The couplings between foregoing components are as illustrated in FIG. 4. In the band-pass filter 400, an input signal is sequentially filtered by the input terminal 410, the resonator 431, the transmission line 441, the resonator 432, the transmission line 442, the resonator 433, and the output terminal 420. Even though this band-pass filter can filter signals effectively, it cannot suppress sideband interferences effectively regarding the frequency response thereof.

SUMMARY OF THE INVENTION

Accordingly, the present invention is directed to a filtering circuit and a structure thereof, wherein the filtering circuit has a simple structure and is easy to implement, and accordingly the fabrication cost of the filtering circuit is low and a good yield thereof in mass production can be achieved.

The present invention provides a filtering circuit including an input terminal, an output terminal, a resonant circuit, a first coupling portion, and a second coupling portion. The resonant circuit is coupled between the input terminal and the output terminal and includes M resonators which are arranged in sequence, wherein adjacent resonators are coupled with each other so that an input signal is transmitted from the $1^{st}$ resonator to the $2^{nd}$ resonator, from the $2^{nd}$ resonator to the $3^{rd}$ resonator, and so on, until the input signal is transmitted from the $(M-1)^{th}$ resonator to the $M^{th}$ resonator. The first coupling portion is coupled to the $i^{th}$ resonator, and the second coupling portion is coupled to the $j^{th}$ resonator. M is a natural number greater than or equal to 3, and the difference between i and j is greater than or equal to 2. An input signal received by the input terminal is filtered by the resonant circuit and then transmitted to the output terminal. In addition, a part of the input signal received by the input terminal is transmitted from the $1^{st}$ resonator to the $i^{th}$ resonator and then transmitted to the second coupling portion via the first coupling portion through cross-coupling.

The present invention provides a filtering circuit structure including an input transmission line, an output transmission line, a resonant circuit, a first coupling portion, and a second coupling portion. The resonant circuit is coupled between the input transmission line and the output transmission line and includes M resonators which are arranged in sequence, wherein adjacent resonators are coupled with each other so that an input signal is transmitted from the input transmission line to the $1^{st}$ resonator, from the $1^{st}$ resonator to the $2^{nd}$ resonator, from the $2^{nd}$ resonator to the $3^{rd}$ resonator, and so on, until the input signal is transmitted from the $(M-1)^{th}$ resonator to the $M^{th}$ resonator and then from the $M^{th}$ resonator to the output transmission line. The first coupling portion is coupled to the $i^{th}$ resonator, and the second coupling portion is coupled to the $j^{th}$ resonator. The first coupling portion is coupled to the input transmission line, and the second coupling portion is coupled to the output transmission line and is parallel to the first coupling portion. M is a natural number greater than or equal to 3, and the difference between i and j is greater than or equal to 2. An input signal received by the input terminal is filtered by the resonant circuit and then transmitted to the output terminal. In addition, a part of the input signal received by the input terminal is transmitted from the $1^{st}$ resonator to the $i^{th}$ resonator and then to the second coupling portion via the first coupling portion through cross-coupling.

In the present invention, an input signal is transmitted to the second coupling portion via the first coupling portion through cross-coupling, so that transmission zeros can be produced around the operation band for further suppressing sideband interferences. Thus, the filter provided by the present invention has good performance in sideband interference suppression. Moreover, the filtering circuit provided by the present invention, has simple structure and accordingly is easy to implement and has low fabrication cost. Thereby, a good yield can be achieved in mass production of the filtering circuit in the present invention.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
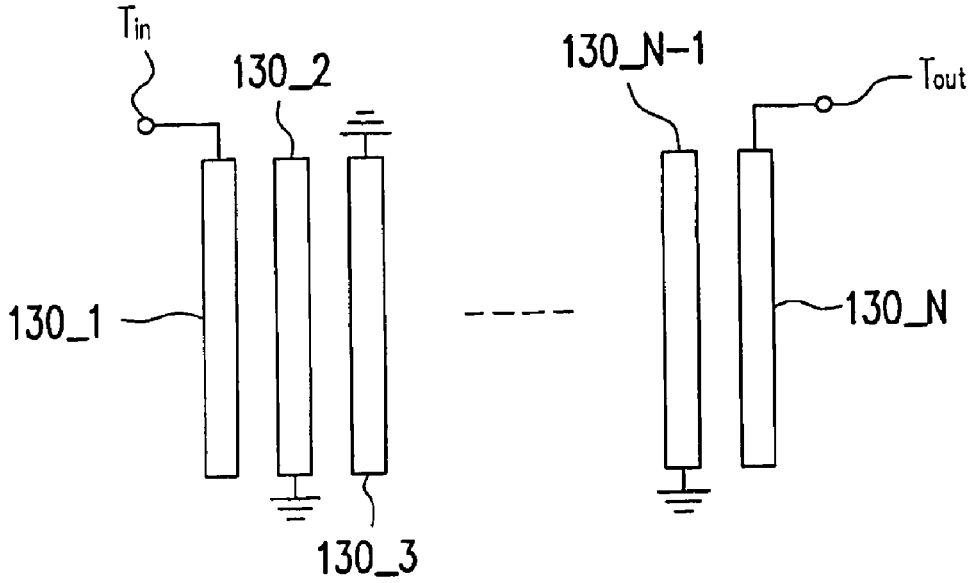
FIG. 1 (PRIOR ART)
FIG. 1 is a circuit diagram of a conventional quarter wavelength inter-digital coupled-line filter implemented with microstrips.
Figure 2:
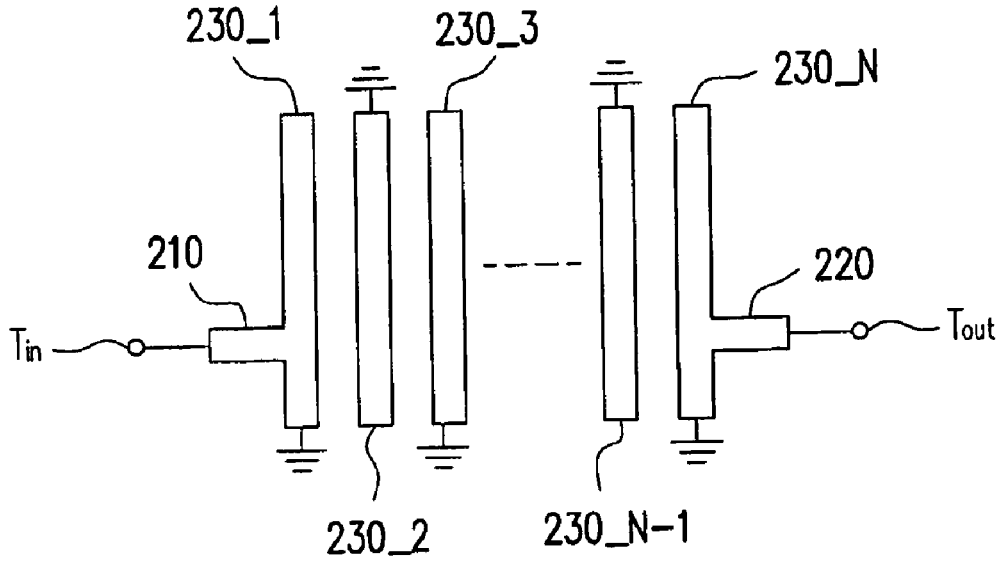
FIG. 2 (PRIOR ART)
FIG. 2 is a circuit diagram of another conventional quarter wavelength inter-digital coupled-line filter implemented with microstrips.
Figure 3:
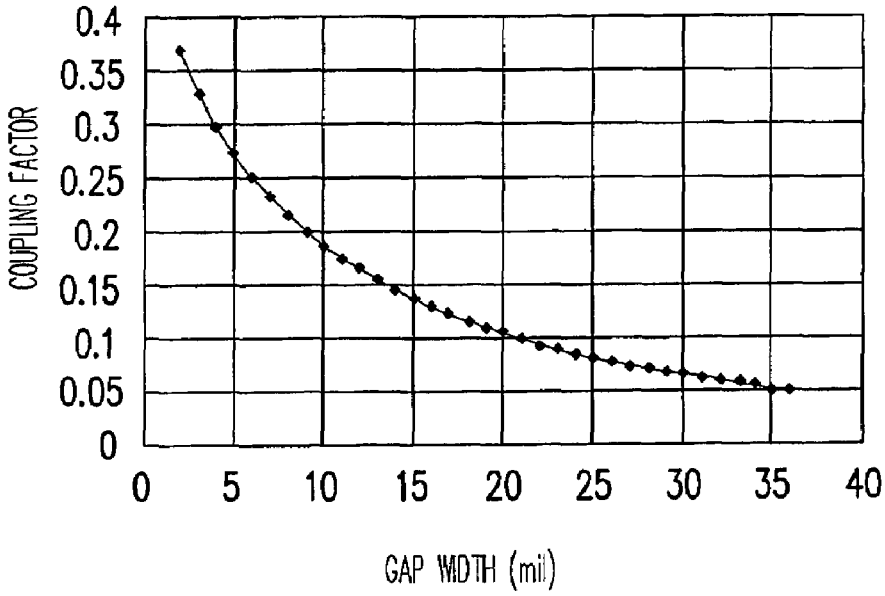
FIG. 3 (PRIOR ART)
FIG. 3 illustrates the affection of the gap width between parallel coupled microstrips to signal coupling with fixed substrate thickness, substrate dielectric coefficient, and line width.
Figure 4:
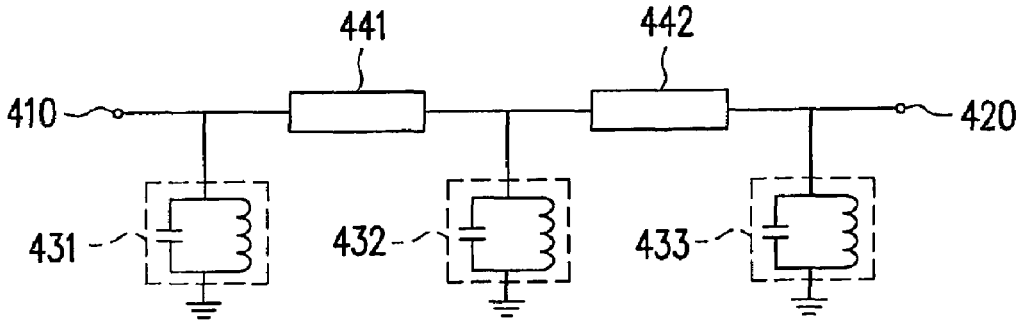
FIG. 4 (PRIOR ART)
FIG. 4 is a circuit diagram of a conventional band-pass filter with quarter wavelength transmission lines.

Reference will now be made in detail to the present preferred embodiments of the invention, examples of which are illustrated in the accompanying drawings. Wherever possible, the same reference numbers are used in the drawings and the description to refer to the same or like parts.

Figure 5A:
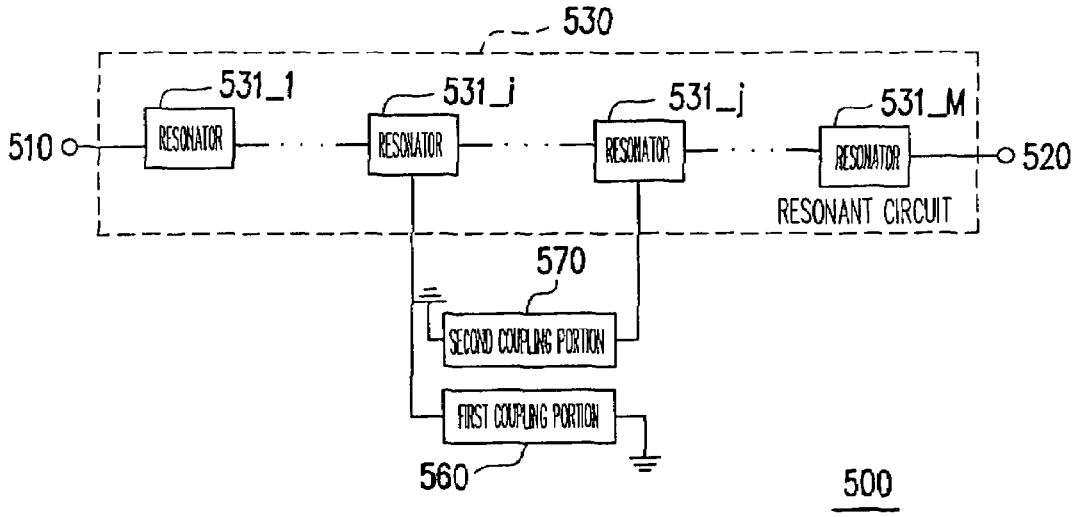
FIG. 5A is a block diagram of a filtering circuit according to an embodiment of the present invention.

FIG. 5A is a block diagram of a filtering circuit according to an embodiment of the present invention. Referring to FIG. 5A, the filtering circuit 500 includes an input terminal 510, an output terminal 520, a resonant circuit 530, a first coupling portion 560, and a second coupling portion 570. The resonant circuit 530 includes M resonators 531_1~531_M, wherein M is a natural number greater than or equal to 3. The couplings between foregoing components are as illustrated in FIG. 5A. In the present embodiment, the first coupling portion 560 and the second coupling portion 570 are respectively coupled to two non-adjacent resonators 531_i and 531_j, namely, $|i-j| \geqq 2$. The resonant circuit 530 is used for filtering out the power of a signal (received by the input terminal 510) outside of the operation band, namely, the resonant circuit 530 is used for performing band-pass filtering. In the present embodiment, the first coupling portion 560 and the second coupling portion 570 may be implemented with two parallel transmission lines, and accordingly, a signal received by the input terminal 510 can be transmitted from the first coupling portion 560 to the second coupling portion 570 through cross-coupling. The cross-coupling pattern described above can suppress sideband interferences, and which has simple structure and is easy to implement, therefore the filtering circuit in the present embodiment has better performance in sideband interference suppression compared to the conventional technique.

Figure 5B:
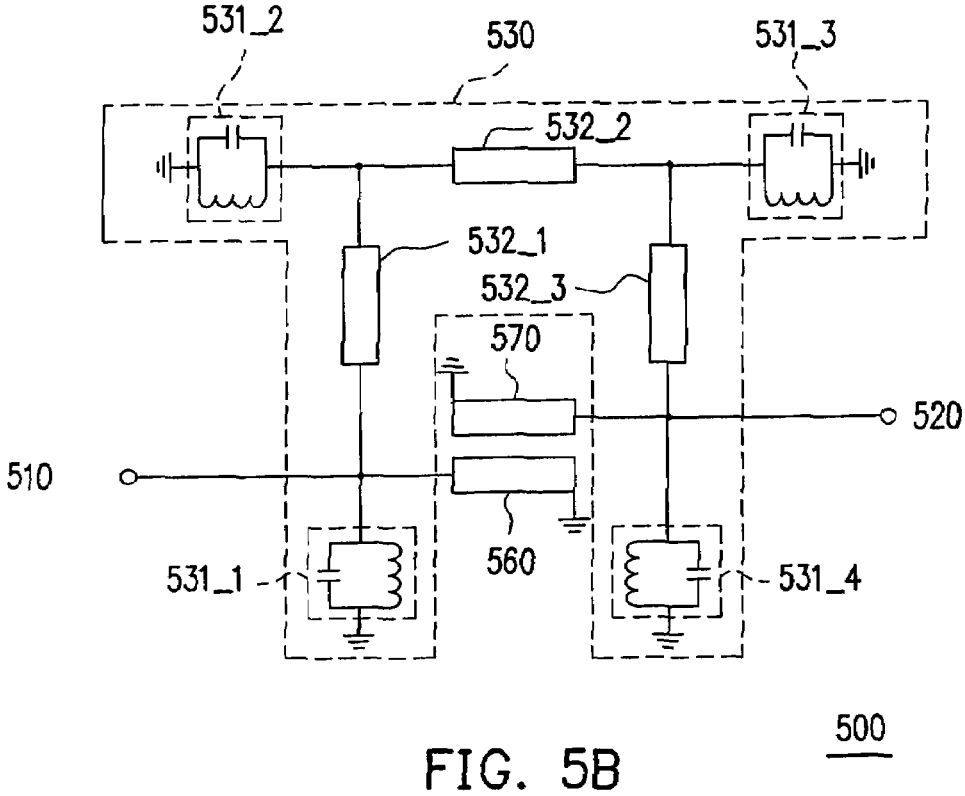
FIG. 5B is a circuit diagram of a filtering circuit according to an embodiment of the present invention.

An implementation of the filtering circuit 500 will be described with reference to an embodiment of the present invention so that those having ordinary knowledge in the art can implement the present invention according to the present disclosure, wherein the resonant circuit 530 is implemented with 4 resonators, namely, M=4, and the values of i and j are respectively 1 and 4. FIG. 5B is a circuit diagram of a filtering circuit according to an embodiment of the present invention. Referring to FIG. 5B, the filtering circuit 500 includes an input terminal 510, an output terminal 520, a resonant circuit 530, a first coupling portion 560, and a second coupling portion 570. The resonant circuit 530 is coupled between the input terminal 510 and the output terminal 520. The resonant circuit 530 includes 4 resonators 531_1~531_4 and 3 transmission lines 532_1~532_3. The couplings between foregoing components are as illustrated in FIG. 5B. In the present embodiment, each of the resonators 531_1~531~4 includes an inductive device and a capacitive device, wherein the capacitive device is connected in parallel to the inductive device for filtering a signal received by the input terminal 510. Additionally, in the present embodiment, the transmission lines 532_1~532_3, the first coupling portion 560, and the second coupling portion 570 may be implemented with microstrips or striplines.

As shown in FIG. 5B, one terminal of the first coupling portion 560 is coupled to the input terminal 510, and the other terminal thereof is grounded. One terminal of the second coupling portion 570 is coupled to the output terminal 520, and the other terminal thereof is grounded. In the present embodiment, the first coupling portion 560 is adjacent to the second coupling portion 570, therefore in a radio frequency (RF) circuit, a high-frequency signal in the first coupling portion 560 can be transmitted to the second coupling portion 570.

It can be understood from the circuit structure of the filtering circuit 500 that a signal received by the input terminal 510 reaches the output terminal 520 via two paths. The first path is composed of the resonator 531_1, the transmission line 532_1, the resonator 531_2, the transmission line 532_2, the resonator 531_3, the transmission line 532_3, and the resonator 531_4. The power of a signal (received by the input terminal 510) outside of the operation band is filtered out after the signal is transmitted through the first path, and the filtered signal is then output by the output terminal 520. The second path is composed of the first coupling portion 560 and the second coupling portion 570. Through the second path, the signal received by the input terminal 510 is transmitted from the first coupling portion 560 to the second coupling portion 570 through cross-coupling and then output by the output terminal 520.

In foregoing first path, the transmission lines 532_1~532_3 inside the filtering circuit 500 are connected in sequence. In the present embodiment, the length and width of the transmission lines can be adjusted so that the signals transmitted through the first path and the second path can have the same frequency and a phase difference of 180° at a frequency point adjacent to the operation band and accordingly a transmission zero can be produced. The transmission zero can adjust the frequency response of the filtering circuit 500 so that sideband interferences can be completely blocked out of the operation band.

Moreover, as described in foregoing embodiment, in the first path, a transmission line is used for coupling two adjacent resonators so that a signal in the previous resonator can be transmitted to the next resonator through the transmission line. Thus, in the filtering circuit in foregoing embodiment, signal coupling between the resonators can be increased by simply increasing the width of the transmission lines. Compared to the conventional quarter wavelength inter-digital coupled-line filter, the affection of process variation to the filtering circuit can be greatly reduced in the present embodiment.

Figure 6:
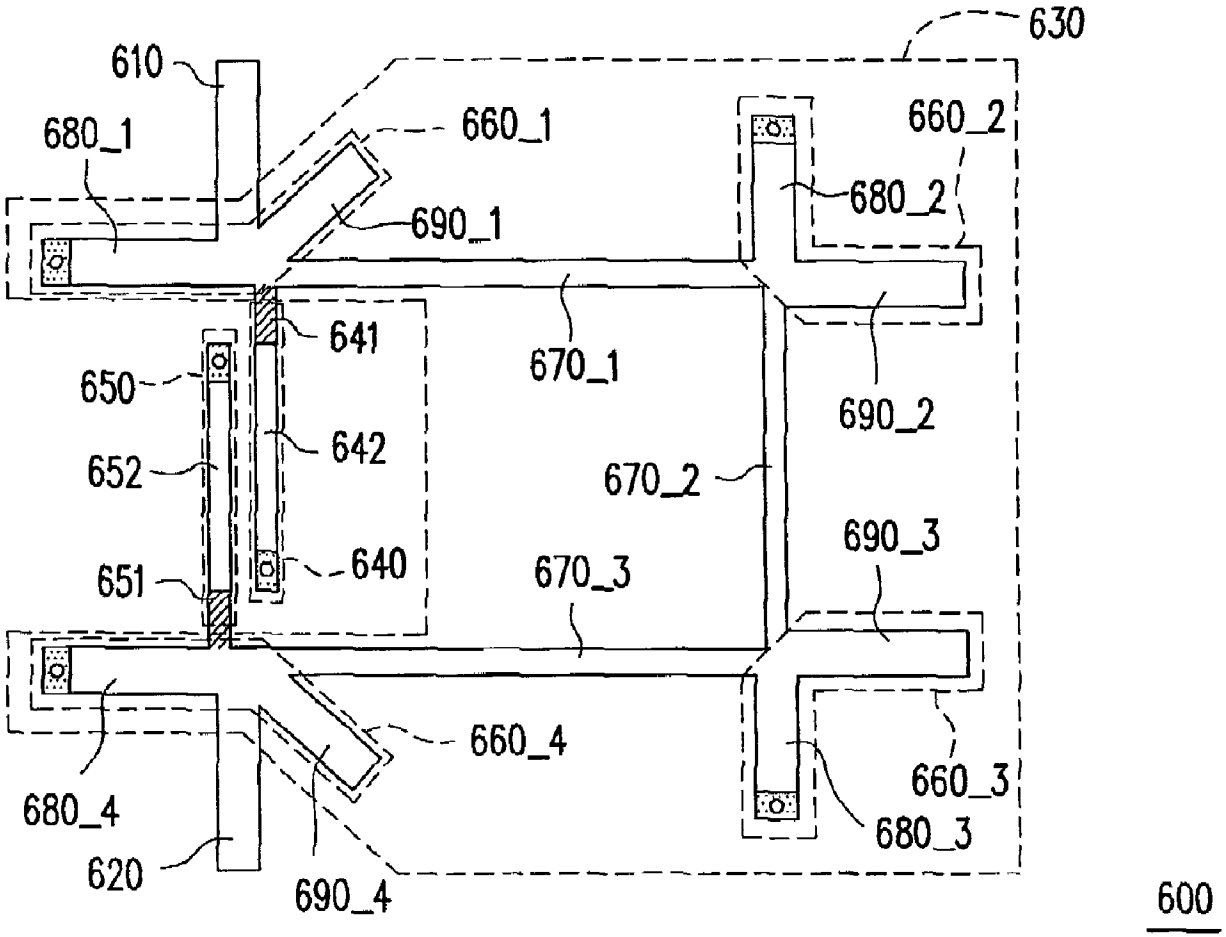
FIG. 6 is a layout diagram illustrating the structure of the filtering circuit in FIG. 5B.

Below, an actual circuit layout of the filtering circuit 500 illustrated in FIG. 5B on a printed circuit board (PCB) will be described so that those having ordinary knowledge in the art can implement the present invention according to the present disclosure. FIG. 6 is a layout diagram illustrating the structure of the filtering circuit in FIG. 5B. Referring to FIG. 6, the filtering circuit structure 600 includes an input transmission line 610, an output transmission line 620, a resonant circuit 630, a first coupling portion 640, and a second coupling portion 650. The resonant circuit 630 is coupled between the input transmission line 610 and the output transmission line 620. The input transmission line 610 receives an input signal. The input signal is then filtered by the resonant circuit 630. After that, the output transmission line 620 outputs the filtered signal. Besides, a part of the input signal received by the input transmission line 610 is transmitted from the first coupling portion 640 to the second coupling portion 650.

As shown in FIG. 6, the resonant circuit 630 includes resonators 660_1~660_4 and transmission lines 670_1~670_3, wherein the $1^{st}$ transmission line 670_1 is coupled to the input transmission line 610, and the other transmission lines 670_2~670_3 are sequentially coupled to the output transmission line 620. Each of the resonators 660_1~660_4 includes an inductive device and a capacitive device and is respectively disposed between adjacent two of the transmission lines 670_1~670_3, the input transmission line 610, and the output transmission line 620. For example, the resonator 660_1 includes an inductive device 680_1 and a capacitive device 690_1, and the resonator 660_1 is coupled between the input transmission line 610 and the transmission line 670_1. Additionally, the components in FIG. 6 may be grounded by connecting the components to conductors having ground voltage level through via.

As shown in FIG. 6, all the inductive devices may be implemented with transmission lines having one terminals thereof grounded and the electrical length thereof smaller than a quarter wavelength, namely, all the inductive devices may be implemented with short stubs. Besides, all the capacitive devices may be implemented with transmission lines having one terminals thereof open and the electrical length thereof smaller than a quarter wavelength, namely, all the capacitive devices may be implemented with open stubs. In addition, all the transmission lines in FIG. 6 may be implemented with microstrips and striplines. Moreover, in the circuit layout illustrated in FIG. 6, all the transmission lines 670_1~670_3 are laid out in straight lines. However, in an actual layout, the transmission lines 670_1~670 3 can be implemented in curve lines, for example, in meander lines, in order to reduce the surface area of the circuit.

In the present embodiment, the first coupling portion 640 includes a first extension 641 and a first transmission portion 642, and the second coupling portion 650 includes a second extension 651 and a second transmission portion 652. The first transmission portion 642 of the first coupling portion 640 is opposite to the second transmission portion 652 of the second coupling portion 650 so that the first transmission portion 642 can be coupled to the second transmission portion 652. In addition, the signal coupled between the first coupling portion 640 and the second coupling portion 650, and accordingly the frequency response of the filtering circuit, can be adjusted by adjusting the lengths of the first extension 641 and the second extension 651. In the actual layout, the first extension 641 and the first transmission portion 642 in the first coupling portion 640 are located on the same metal layer. However, in the circuit layout illustrated in FIG. 6, the first extension 641 and the first transmission portion 642 are illustrated in different colors. Similarly, the second extension 651 and the second transmission portion 652 in the second coupling portion 650 are also illustrated in different colors.

Figure 7:
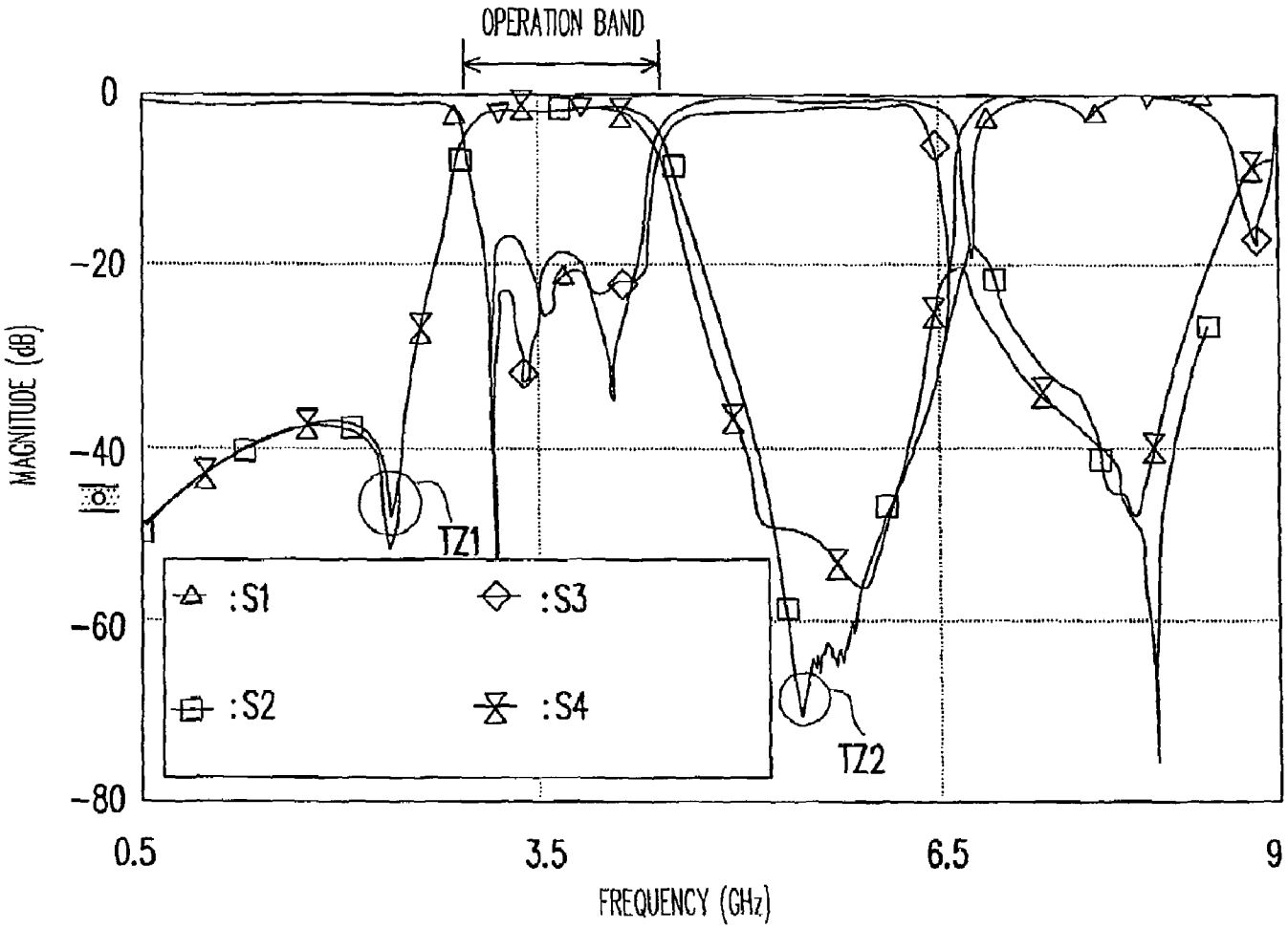
FIG. 7 is a frequency response waveform according to an embodiment of the present invention.

Next, the frequency response of the filtering circuit structure 600 will be simulated by using an electromagnetic simulation software, and the actual frequency response of the filtering circuit structure 600 will be measured in order to validate the performance of the filtering circuit structure 600. FIG. 7 is a frequency response waveform according to an embodiment of the present invention. Referring to FIG. 7, the ordinate in FIG. 7 represents magnitude in unit of dB, and the abscissa in FIG. 7 represents the frequency in unit of GHz. Curve S1 is an actual reflective response waveform of the filtering circuit structure 600. Curve S2 is an actual transmission response waveform of the filtering circuit structure 600. Curve S3 is a simulated reflective response waveform of the filtering circuit 600. Curve S4 is a simulated transmission response waveform of the filtering circuit 600. As shown in FIG. 7, the simulated results and the measure results of the filtering circuit 600 are very close. Besides, it can be observed from the transmission response waveforms S2 and S4 that there are two transmission zeros TZ1 and TZ2 around the operation band, and these two transmission zeros TZ1 and TZ2 can be used for further suppressing sideband interferences. Accordingly, the filtering circuit in the present embodiment has better performance in sideband interference suppression compared to the conventional technique.

Moreover, the resonant circuit 530 may also include other numbers of resonators and transmission lines, which will be described below. In following embodiment, M represents the number of resonators, and since a transmission line is disposed between two resonators, M−1 represents the number of transmission lines, wherein M is a natural number.

Figure 8:
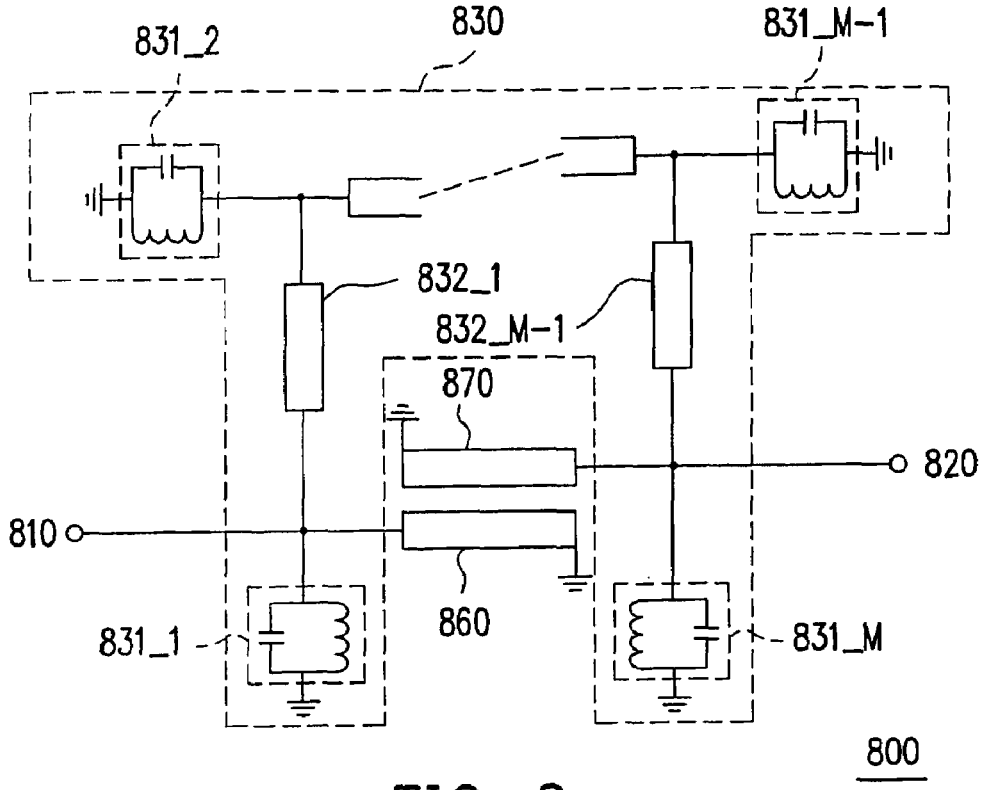
FIG. 8 is a circuit diagram of a filtering circuit according to an embodiment of the present invention.

FIG. 8 is a circuit diagram of a filtering circuit according to an embodiment of the present invention. Referring to FIG. 8, the filtering circuit 800 includes an input terminal 810, an output terminal 820, a resonant circuit 830, a first coupling portion 860, and a second coupling portion 870. The resonant circuit 830 is coupled between the input terminal 810 and the output terminal 820. The resonant circuit 830 includes M resonators 831_1~831_M and M−1 transmission lines 832_1~832_M−1, wherein each of the transmission lines 832_1~832_M−1 has a first terminal and a second terminal. Taking the $i^{th}$ transmission line as example, the first terminal of the $i^{th}$ transmission line is coupled to the $i^{th}$ resonator, and the second terminal thereof is coupled to the $(i+1)^{th}$ resonator, wherein i is a natural number and i<=M.

Figure 9:
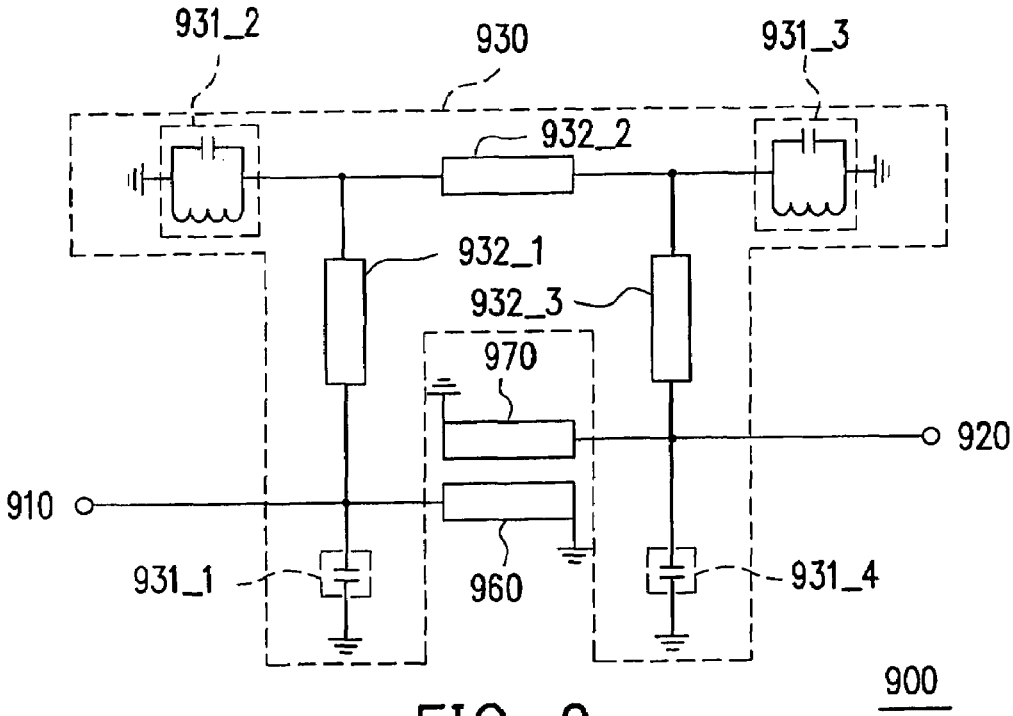
FIG. 9 is a circuit diagram of a filtering circuit according to an embodiment of the present invention.

Below, another embodiment of the present invention will be described so that those having ordinary knowledge in the art can implement the present invention according to the present disclosure. FIG. 9 is a circuit diagram of a filtering circuit according to an embodiment of the present invention. Referring to FIG. 9, the filtering circuit 900 is similar to the filtering circuit 500 illustrated in FIG. 5B and the similar part will not be described herein. The difference between the filtering circuit 900 and the filtering circuit 500 in FIG. 5B is that the first coupling portion 560 and the second coupling portion 570 in FIG. 5B are implemented with microstrips or striplines, while the first coupling portion 960 and the second coupling portion 970 in FIG. 9 are implemented with inductive devices. Thus, the first coupling portion 960 and the second coupling portion 970 can be used for replacing the inductive devices in the resonators 531_1 and 531_4 in FIG. 5B, and the resonators 931_1 and 931_4 in FIG. 9 can be respectively composed of only a capacitive device. In other words, a signal received by the input terminal 910 can be filtered by the capacitive device in the resonator 931_1 and the inductive coupling portion 960, and a signal output by the transmission line 932_3 can be filtered by the capacitive device in the resonator 931_4 and the inductive second coupling portion 970. Meanwhile, in the filtering circuit 900, the first coupling portion 960 can transmit a high-frequency signal to the second coupling portion 970 so as to form foregoing second path for transmitting signals. Accordingly, the filtering circuit 900 has all the advantages of the filtering circuit 500 and a simpler structure compared to the filtering circuit 500.

Figure 10:
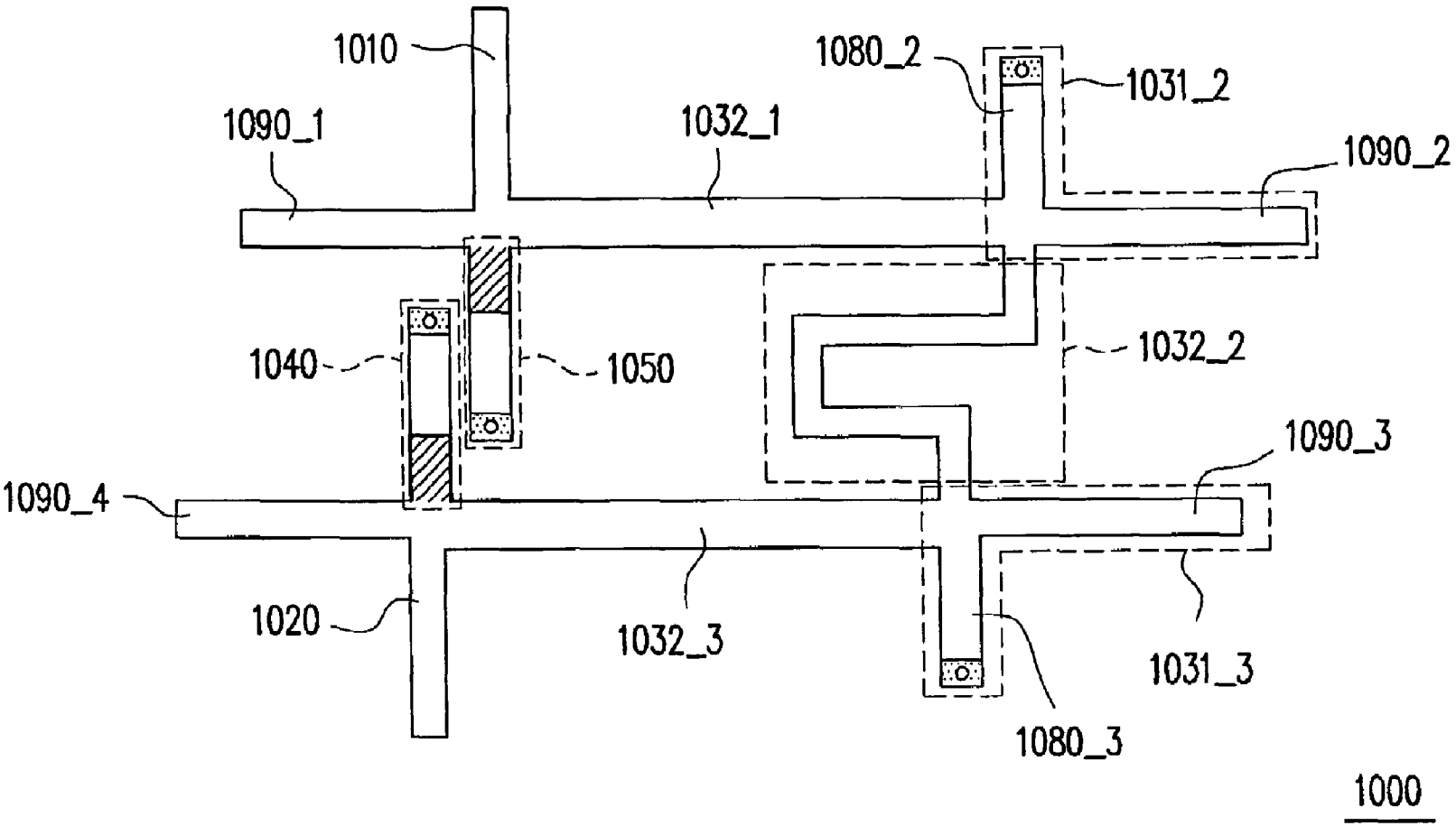
FIG. 10 is a layout diagram illustrating the structure of the filtering circuit in FIG. 9.

An actual circuit layout of the filtering circuit 900 illustrated in FIG. 9 on a PCB will be described below. FIG. 10 is a layout diagram illustrating the structure of the filtering circuit in FIG. 9. Referring to FIG. 10, the filtering circuit structure 1000 in FIG. 10 is similar to the filtering circuit structure illustrated in FIG. 6 and the similar part will not be described herein. As shown in FIG. 10, an inductive device is respectively disposed in the first coupling portion 1040 and the second coupling portion 1050 for replacing the microstrip or stripline in FIG. 10. Thus, the first coupling portion 1040 and the second coupling portion 1050 may be used as both the inductive devices in the resonators 640 and 650 illustrated in FIG. 6 and a cross-coupling transmission path. Accordingly, the surface area of the circuit is reduced. In addition, since the first coupling portion 1040 and the second coupling portion 1050 are implemented with inductive devices, the gap width between the resonators 1031_2 and 1031_3 is reduced. Besides, since the length of the transmission line 1032_2 is close to the lengths of the transmission lines 1031_1 and 1031_3, the transmission line 1032_2 in FIG. 10 may be laid out in a curved line.

Figure 11:
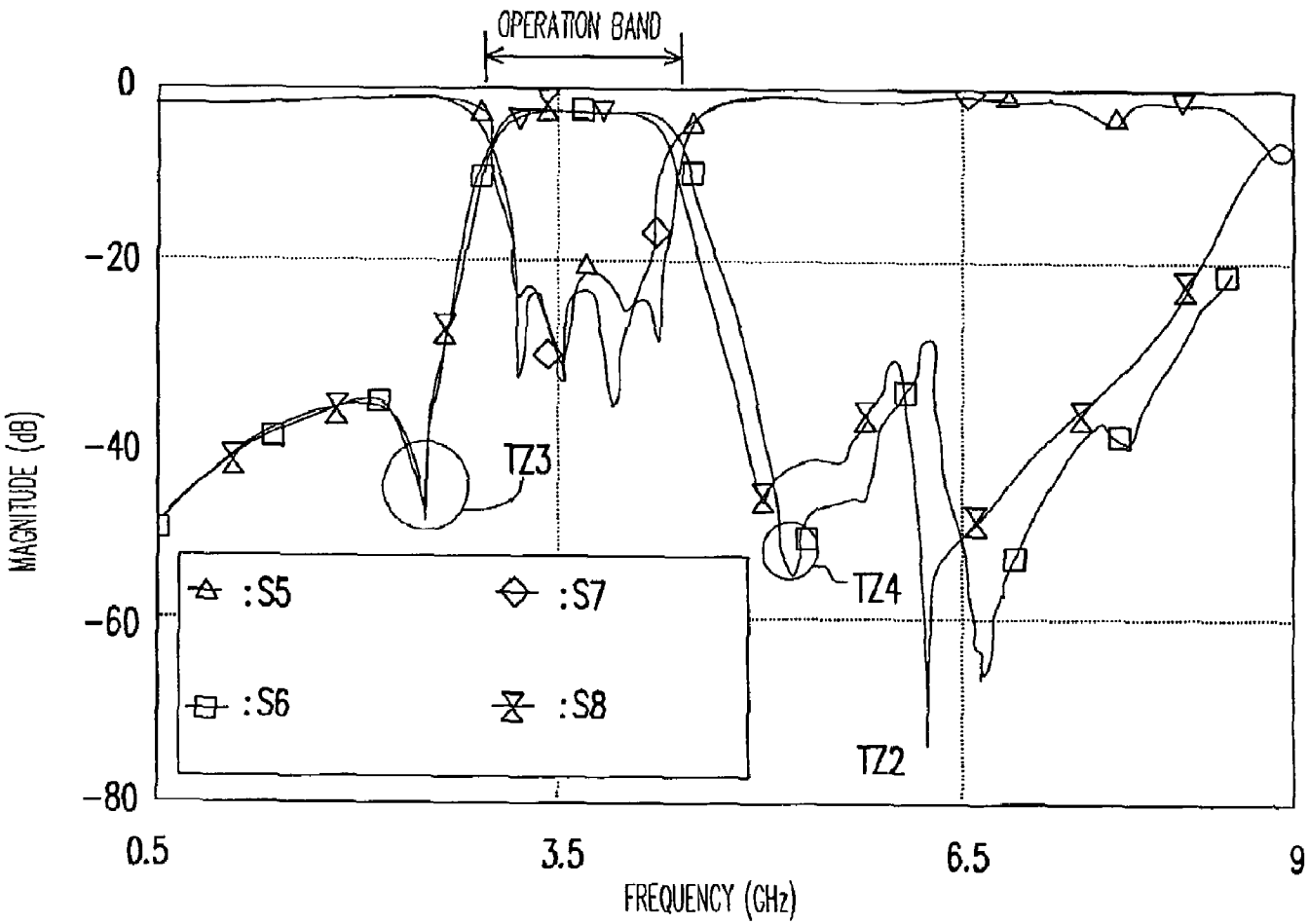
FIG. 11 is a frequency response waveform according to an embodiment of the present invention.

Finally, the frequency response of the filtering circuit structure 1000 will be simulated by using an electromagnetic simulation software, and the actual frequency response of the filtering circuit structure 1000 will be measured in order to validate the performance of the filtering circuit structure 1000. FIG. 11 is a frequency response waveform according to an embodiment of the present invention. Referring to FIG. 11, the ordinate in FIG. 11 represents magnitude in unit of dB, and the abscissa in FIG. 11 represents the frequency in unit of GHz. Curve S5 is an actual reflective response waveform of the filtering circuit structure 1000. Curve S6 is an actual transmission response waveform of the filtering circuit structure 1000. Curve S7 is a simulated reflective response waveform of the filtering circuit structure 1000. Curve S8 is a simulated transmission response waveform of the filtering circuit structure 1000. As shown in FIG. 12, the measured results and the simulated results of the filtering circuit structure 1000 are very close. Besides, it can be observed from the transmission response waveforms that there are two transmission zeros TZ3 and TZ4 around the operation band. Accordingly, the filtering circuit in the present embodiment can also suppress sideband interferences.

In overview, the filtering circuit and the structure thereof provided by the present invention have at least following advantages.

(1) The filtering circuit in the present invention has a simple structure and is easy to implement, and accordingly the fabrication cost thereof is low.

(2) In the filtering circuit structure provide by the present invention, the power loss of a signal can be reduced by simply increasing the width of the transmission lines in the filtering circuit structure. Thus, compared to the conventional quarter wavelength inter-digital coupled-line filter, the performance of the filtering circuit provided by the present invention will not be affected by slight process variation. Accordingly, a good yield can be achieved in mass production of the filtering circuit provided by the present invention.

(3) In the present invention, a signal is transmitted from the first coupling portion to the second coupling portion through cross-coupling, so that transmission zeros can be produced around the operation band for further suppressing sideband interferences. Thus, the filter provided by the present invention has good performance in sideband interference suppression.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A filtering circuit, comprising:

an input terminal;

an output terminal;

a resonant circuit, coupled between the input terminal and the output terminal, the resonant circuit comprising M resonators arranged in sequence for transmitting a signal received by the input terminal to the output terminal via the resonant circuit, wherein M is a natural number greater than or equal to 3, the adjacent resonators are coupled with each other, the 1st resonator is coupled to the input terminal, and the $M^{th}$ resonator is coupled to the output terminal, wherein the resonant circuit further comprises M−1 transmission lines, respectively having a first terminal and a second terminal, wherein the $k^{th}$ transmission line couples between the $k^{th}$ resonator and the $(k+1)^{th}$ resonator, and k is a natural number and k<=M;

a first coupling portion, coupled to the $i^{th}$ resonator; and a second coupling portion, coupled to the $j^{th}$ resonator, wherein the difference between i and j is greater than or equal to 2, and a part of th the signal received by the input terminal is transmitted from the 1st resonator to the $i^{th}$ resonator and then coupled to the second coupling portion via the first coupling portion.

2. The filtering circuit according to claim 1, wherein the $1^{st}$ resonator and the $M^{th}$ resonator respectively comprise a capacitive device.

3. The filtering circuit according to claim 2, wherein each of the $2^{nd}$ resonator to the $(M-1)^{th}$ resonator comprises:

an inductive device; and a capacitive device, connected in parallel to the inductive device.

4. A filtering circuit, comprising:

an input terminal;

an output terminal;

a resonant circuit, coupled between the input terminal and the output terminal, the resonant circuit comprising M resonators arranged in sequence for transmitting a signal received by the input terminal to the output terminal via the resonant circuit, wherein M is a natural number greater than or equal to 3, the adjacent resonators are coupled with each other, the 1st resonator is coupled to the input terminal, and the $M^{th}$ resonator is coupled to the output terminal, wherein each of the resonators comprises:

an inductive device; and a capacitive device, connected in parallel to the inductive device;

a first coupling portion, coupled to the $i^{th}$ resonator; and a second coupling portion, coupled to the $j^{th}$ resonator, wherein the difference between i and j is greater than or equal to 2, and a part of the signal received by the input terminal is transmitted from the 1st resonator to the $i^{th}$ resonator and then coupled to the second coupling portion via the first coupling portion.

5. The filtering circuit according to claim 4 further comprising:

an input transmission line, having a first terminal coupled to the input terminal and a second terminal coupled between the 1st transmission line and the 1st resonator; and an output transmission line, having a first terminal coupled to the output terminal and a second terminal coupled between the $(M-1)^{th}$ transmission line and the $M^{th}$ resonator.

6. The filtering circuit according to claim 5, wherein the first coupling portion has a first terminal coupled to the second terminal of the input transmission line and a second terminal which is grounded.

7. The filtering circuit according to claim 5, wherein the second coupling portion has a first terminal coupled to the second terminal of the output transmission line and a second terminal which is grounded.

8. A filtering circuit structure, comprising:

an input terminal;

an output terminal;

a resonant circuit, coupled between the input terminal and the output terminal, the resonant circuit comprising M resonators for transmitting a signal received by the input terminal to the output terminal via the resonant circuit, wherein M is a natural number greater than or equal to 3, the adjacent resonators are coupled with each other, the 1st resonator is coupled to the input terminal, and the $M^{th}$ resonator is coupled to the output terminal, wherein the resonant circuit further comprises:

M−1 transmission lines, wherein the 1st transmission line is coupled to the input terminal, and the other transmission lines are sequentially coupled to the output terminal, and the resonators are respectively disposed between adjacent two of the transmission lines, the input terminal, and the output terminal;

a first coupling portion, coupled to the $i^{th}$ resonator; and a second coupling portion, coupled to the $j^{th}$ resonator and being parallel to the first coupling portion;

wherein the difference between i and j is greater than or equal to 2, and a part of the signal received by the input terminal is transmitted from the 1st resonator to the $i^{th}$ resonator and then coupled to the second coupling portion via the first coupling portion.

9. The filtering circuit structure according to claim 8 further comprising:

an input transmission line, having a first terminal coupled to the input terminal and a second terminal coupled between the 1st transmission line and the 1st resonator; and an output transmission line, having a first terminal coupled to the output terminal and a second terminal coupled between the $(M-1)^{th}$ transmission line and the $M^{th}$ resonator.

10. The filtering circuit structure according to claim 8, wherein the first coupling portion comprises:

a first extension; and a first transmission portion, coupled to the first extension.

11. The filtering circuit structure according to claim 10, wherein the second coupling portion comprises:

a second transmission portion, opposite to the first transmission portion; and a second extension, coupled to the second transmission portion;

wherein the first transmission portion transmits the signal to the second transmission portion.

12. The filtering circuit structure according to claim 8, wherein each of the resonators comprises:

an inductive device; and a capacitive device, connected in parallel to the inductive device.

13. The filtering circuit structure according to claim 12, wherein the inductive device is a short stub.

14. The filtering circuit structure according to claim 12, wherein the capacitive device is an open stub.

15. The filtering circuit structure according to claim 8, wherein the 1st resonator and the $M^{th}$ resonator respectively comprise:

a capacitive device.

16. The filtering circuit structure according to claim 15, wherein each of the 2nd resonator to the $(M-1)^{th}$ resonator comprises:

an inductive device; and a capacitive device, connected in parallel to the inductive device.

17. The filtering circuit structure according to claim 16, wherein the inductive device is a short stub.

18. The filtering circuit structure according to claim 16, wherein the capacitive device is an open stub.

* * * * *